United States Patent [19]

Kubo et al.

[11] Patent Number: 4,615,733

[45] Date of Patent: Oct. 7, 1986

[54] COMPOSITE MATERIAL INCLUDING REINFORCING MINERAL FIBERS EMBEDDED IN MATRIX METAL

[75] Inventors: Masahiro Kubo; Tadashi Dohnomoto; Atsuo Tanaka; Yoshiaki Tatematsu, all of Toyota, Japan

[73] Assignee: Toyota Jidosha Kabushiki Kaisha, Toyota, Japan

[21] Appl. No.: 719,247

[22] Filed: Apr. 2, 1985

[30] Foreign Application Priority Data

Oct. 18, 1984 [JP] Japan ..... 59-219091

[51] Int. Cl.[4] ..... B22F 3/12; B22F 1/02

[52] U.S. Cl. ..... 75/229; 75/230; 75/234; 75/235; 419/19

[58] Field of Search ..... 75/229, 230, DIG. 1, 75/234, 235; 419/19

[56] References Cited

U.S. PATENT DOCUMENTS 3,541,659 11/1970 Canell et al. ..... 75/229
4,259,112 3/1981 Delewy, Jr. et al. ..... 75/229

FOREIGN PATENT DOCUMENTS 3074067 3/1983 European Pat. Off. ..... 75/229
2505003 8/1975 Fed. Rep. of Germany ..... 75/229
54-28204 3/1979 Japan ..... 75/229

*Primary Examiner*—Allan M. Lieberman
*Attorney, Agent, or Firm*—Oblon, Fisher, Spivak, McClelland & Maier

[57] ABSTRACT

A composite material, including reinforcing fiber material with principal components $SiO_2$ and/or CaO and/or $Al_2O_3$, and with a Mg content by weight of between about 0% and about 10%, an $Fe_2O_3$ content by weight of between about 0% and about 5%, and a content by weight of other inorganic substances of between about 0% and about 10%, and consisting essentially of mineral fibers and non fibrous particles to a total percentage of not more than about 20% by weight, the weight percentage of the part of the non fibrous particles which have a diameter of greater than or equal to about 150 microns being between about 0% and about 7%. Also, the composite material includes a matrix metal selected from the group consisting of aluminum, magnesium, copper, zinc, lead, tin, and alloys having these as principal components, the volume proportion of the mineral fibers being in the range of from about 4% to about 25%. This composite material is economical to manufacture and has very good wear characteristics, machinability, and bending strength.

7 Claims, 9 Drawing Figures

COMPOSITE MATERIAL INCLUDING REINFORCING MINERAL FIBERS EMBEDDED IN MATRIX METAL

BACKGROUND OF THE INVENTION

The present invention relates to a type of composite material which includes fiber material as a reinforcing material embedded in a mass of matrix metal, and more particularly relates to such a type of composite material in which the reinforcing material is a mineral fiber material and the matrix metal is aluminum, magnesium, copper, zinc, lead, tin, or an alloy having one or more of these as principal component or components.

In the prior art, various composite materials including fiber materials of various kinds as reinforcing material have been proposed. The advantages of such fiber reinforced materials include improved lightness, improved strength, enhanced wear characteristics, improved resistance to head and burning, and so on. In particular, for the fiber reinforcing material, there have been proposed the following kinds of inorganic fiber materials: alumina fiber, alumina-silica fiber, crystallized glass fiber, silicon carbide fiber, and silicon nitride fiber; and of the matrix metal aluminum alloy and various other alloys have been suggested. Such prior art composite materials are disclosed, for example, in Japanese Patent Laying Open Publication Nos. Sho 58-93948 (1983), Sho 58-93837 (1983), Sho 58-93841 (1983), and Sho 59-70736 (1984), of all of which Japanese patent applications the applicant was the same entity as the assignee of the present patent application, and none of which is it intended hereby to admit as prior art to the present application except insofar as otherwise obliged by law.

Inorganic fibers of the types mentioned above, however, are very much harder than the aluminum alloy or the like which is the matrix metal also mentioned above, and accordingly in the case of using these as the reinforcing fibers for a composite material there arise the problems that processing such as machining or the like is extremely difficult, and also that the amount of wear on cooperating parts which are in frictional contact with a part made of such composite material and slide thereagainst tends to be large. Further, inorganic fibers of the types described above are very expensive, and this makes the cost of composite materials including them very high. This cost problem, in fact, is one of the biggest current obstacles to the practical application of composite materials for making many types of actual components. Further, with these types of inorganic fibers used as reinforcing fiber material, the problem tends to arise, during manufacture of the composite material, either that the wettability of the reinforcing fibers with respect to the molten matrix metal is poor, or alternatively, when the reinforcing fibers are well wetted by the molten matrix metal, that a reaction between them tends to deteriorate the reinforcing fibers.

On the other hand, in contrast to the above mentioned inorganic materials, mineral fibers whose principal components are $SiO_2$, CaO, and $Al_2O_3$ are very inexpensive, and therefore if such fibers could satisfactorily be used as reinforcing fiber material for a composite material then the cost could be very much reduced. Further, the wettability of such mineral fibers with respect to molten aluminum alloys and the molten phases of other suitable candidates for consideration as matrix metal materials is very good, and there is little possibility of any harmful reaction occurring between such mineral fibers and such likely matrix metals, so that, as compared with the case of using as reinforcing fiber material a material which has poor wettability with regard to the molten matrix metal, or the case of using a reinforcing fiber material which undergoes a deleterious reaction with the molten matrix metal, a composite material can be manufactured which has superior mechanical characteristics such as strength. However, such mineral fibers, by virtue of their method of manufacture which will be discussed later in this specification, contain as an admixture about 50% by weight of non fibrous particles of various sizes. Since these non fibrous particles have in general much bigger diameters than the mineral fibers themselves, and are extremely hard, problems arise such as that the processing such as machining of a composite material which includes these non fibrous particles is very difficult, excessive wear is produced on cooperating parts which are in frictional contact with and slide against a part made of such composite material, and the strength of the composite material is not sufficiently improved over the strength of the matrix metal material by itself.

SUMMARY OF THE INVENTION

The inventors of the present invention have considered in depth the above detailed problems with regard to the use of mineral fiber material as reinforcing material for a composite material, and as a result of various experimental researches (the results of some of which will be given later) have discovered that, if the total amount of non fibrous particles and also the amount of non fibrous particles with a diameter of 150 microns or greater are kept below certain limits, and also the volume proportion of mineral fibers in the composite material as a whole is kept within certain limits, a satisfactory composite material can be produced.

Accordingly, the present invention is based upon knowledge gained as a result of these experimental researches by the present inventors, and its primary object is to provide a composite material including reinforcing mineral fibers embedded in matrix metal, which has the advantages detailed above with regard to the use of mineral fibers as the reinforcing fiber material, including good mechanical characteristics, while overcoming the above explained disadvantages.

It is a further object of the present invention to provide such a composite material including reinforcing mineral fibers, which utilizes inexpensive materials.

It is a further object of the present invention to provide such a composite material including reinforcing mineral fibers, which is cheap with regard to manufacturing cost.

It is a further object of the present invention to provide such a composite material including reinforcing mineral fibers, which is light.

It is a further object of the present invention to provide such a composite material including reinforcing mineral fibers, which has good mechanical strength.

It is a yet further object of the present invention to provide such a composite material including reinforcing mineral fibers, which has high bending strength.

It is a yet further object of the present invention to provide such a composite material including mineral fibers, which has good resistance against heat and burning.

It is a further object of the present invention to provide such a composite material including reinforcing mineral fibers, which has good machinability.

It is a yet further object of the present invention to provide such a composite material including reinforcing mineral fibers, which does not cause undue wear on a tool by which it is machined.

It is a further object of the present invention to provide such a composite material including reinforcing mineral fibers, which has good wear characteristics with regard to wear on a member made of the composite material itself during use.

It is a yet further object of the present invention to provide such a composite material including reinforcing mineral fibers, which does not cause undue wear on, or scuffing of, a mating member against which a member made of said composite material is frictionally rubbed during use.

It is a yet further object of the present invention to provide such a composite material including reinforcing mineral fibers, in the manufacture of which the fiber reinforcing material has good wettability with respect to the molten matrix metal.

It is a yet further object of the present invention to provide such a composite material including reinforcing mineral fibers, in the manufacture of which, although as mentioned above the fiber reinforcing material has good wettability with respect to the molten matrix metal, no deleterious reaction therebetween substantially occurs.

According to the present invention, these and other objects are accomplished by a composite material, comprising: (a) reinforcing fiber material, with principal components being $SiO_2$ and/or CaO and/or $Al_2O_3$, and with a Mg content by weight of between about 0% and about 10%, an $Fe_2O_3$ content by weight of between about 0% and about 5%, and a content by weight of other inorganic substances of between about 0% and about 10%, and consisting essentially of: (a1) mineral fibers; and (a2) non fibrous particles to a total percentage of not more than about 20% by weight, the weight percentage of the part of said non fibrous particles which have a diameter of greater than or equal to about 150 microns being not greater than about 7%; and (b) a matrix metal selected from the group consisting of aluminum, magnesium, copper, zinc, lead, tin, and alloys having these as principal components; (c) the volume proportion of said mineral fibers being in the range of from about 4% to about 25%.

According to such a composition according to the present invention, the matrix metal is reinforced by these type of mineral fibers, which are very much cheaper than the type of inorganic fibers discussed above with relation to the prior art. Accordingly, the composite material according to the present invention has the advantage that it utilizes much cheaper materials than has heretofore been practicable. Further, these type of mineral fibers have good wettability with respect to the specified type of molten matrix metal, and yet no deleterious reaction therebetween substantially occurs. Yet further, this type of composite material including reinforcing mineral fibers is cheap with regard to manufacturing cost, and, by virtue of the restriction of the amount of reinforcing mineral fibers to between about 4% and about 25% by volume, is light and has good mechanical strength and particularly good bending strength, as will be demonstrated later in this specification with regard to experimental tests. Further, in virtue of the restriction of the total percentage amount of the non fibrous particles to not more than about 20% by weight, and the restriction of the weight percentage of the part of said non fibrous particles which have a diameter of greater than or equal to about 150 microns to between about 0% and about 7%, this composite material including reinforcing mineral fibers has good machinability, and does not cause undue wear on a tool by which it is machined, and a finished part made of this composite material has good wear characteristics with regard to wear on itself during use, and further does not cause undue wear on a mating member against which it is frictionally rubbed during use. Further, this composite material has good resistance against heat and burning.

To discuss this type of mineral fiber material in more detail, "mineral fiber" is a generic name for various sorts of artificial fiber materials, including rock wool or rock fiber which is made by forming molten rock into fibers, slag wool or slag fiber which is made by forming iron slag into fibers, and mineral wool or mineral fiber which is made by forming a molten mixture of rock and slag into fibers. Such mineral fiber generally has a composition of from about 35% to about 50% by weight of $SiO_2$, about 20% to about 40% by weight of CaO, about 10% to about 20% by weight of $Al_2O_3$, about 3% to about 7% by weight of MgO, about 1% to about 5% by weight of $Fe_2O_3$, and about 0% to about 10% by weight of other inorganic substances. Now, this type of mineral fiber material is generally produced by a method such as the spinning method, and during the manufacture of the mineral fiber material inevitably some non fibrous particles, such as globular particles, are produced along with the fibers and are left intermingled therewith. These non fibrous particles are very hard, and quite a large proportion of of them are large compared to the diameter of the fibers, and this causes deterioration of the processability and machinability of the resulting composite material, and excessive wear on mating members against which parts made of the composite material are frictionally rubbed during use. Further, the danger arises that, if large ones of these non fibrous particles should become dislodged from a part made of the composite material during use, they could cause scuffing of such a mating member. According to the results of the various experimental researches carried out by the inventors of the present invention, this type of damage is particularly prevalent in the case of non fibrous particles with diameters greater than or equal to about 150 microns, and accordingly the above detailed restriction that the total percentage amount of the non fibrous particles should be limited to not more than about 20% by weight, and the restriction that the the weight percentage of the part of said non fibrous particles which have a diameter of greater than or equal to about 150 microns should be limited to between about 0% and about 7%, have been arrived at. However, in view of the desirability of further restricting the fibrous particle content, and particularly the large fibrous article content, of the composite material according to the present invention, in order to maximize machinability and wear characteristics thereof, according to a more specialized aspect of the present invention, it has been recognized that the objects detailed above of the present invention are even more well and properly accomplished by a composite material as described above, wherein the total percentage of said non fibrous particles is not greater than about 10% by weight, and the weight percentage of the part of said non fibrous particles which have a diameter of greater than or equal to about 150 microns is not greater than about 2%.

Now, in the case of a composite material which utilizes alumina fiber material or the like, as detailed in the part of this specification entitled "Background of the Invention", as the reinforcing fiber material, then even if the volume proportion of the reinforcing fiber material is very small, or instance about 0.5%, then good results with regard to improvement of wear resistance and so on can be obtained; but, in the case of using mineral fiber material as the reinforcing fiber material as in the present invention, since these mineral fibers have relatively low strength and hardness as compared to such expensive and hard prior art type reinforcing fibers as alumina fibers and so on, according to the results of the various experimental researches carried out by the inventors of the present invention, the above detailed restriction that the volume proportion of said mineral fibers should not be less than about 4% has been arrived at, since otherwise satisfactory strength and wear resistance and mating part wear characteristics and the like are difficult to attain. Further, in the case of such a composite material which utilizes alumina fiber material or the like, the strength of the composite material increases with an increase in the volume proportion of the reinforcing fiber material, up to a large volume proportion of the reinforcing fiber material; but, again according to the results of the various experimental researches carried out by the inventors of the present invention, it has been found that, as the volume percentage of the reinforcing fiber material rises above 20%, and particularly as it rises above 25%, the strength of the resulting composite material drops sharply. Accordingly, the above detailed restriction that the volume proportion of said mineral fibers should not be greater than about 25% has been arrived at. However, taking into consideration various experimental results some of which will be detailed later in this specification, it is considered that the objects detailed above of the present invention are even more well and properly accomplished by a composite material as first described above, wherein the volume proportion of said mineral fibers is in the range of from about 5% to about 20%.

Yet further, since the mineral material from which the mineral fibers are formed has a relatively low viscosity in the molten state, and since the mineral fibers are relatively fragile as compared with such expensive and hard prior art type reinforcing fibers as alumina fibers and so on, the mineral fibers are produced in the form of short or non continuous fibers with a fiber diameter of between about 1 and about 10 microns, and with a fiber length of between about 10 microns and about 10 centimeters. Therefore, when the availability of low cost mineral fibers is taken into consideration, it is considered to be desirable that the mineral fibers as used in the composite material of the present invention should have an average fiber diameter of between about 2 and about 8 microns, and an average fiber length of between about 20 microns and about 5 centimeters; and in the case of the powder metallurgy method being used to make the composite material, as will be detailed later in this specification, it is desirable that the average fiber length should be between about 20 microns and about 2 millimeters.

BRIEF DESCRIPTION OF THE DRAWINGS

The present invention will now be described in terms of several preferred embodiments thereof, and with reference to the appended drawings. However, it should be understood that the description of the embodiments, and the drawings, are not any of them intended to be limitative of the scope of the present invention, since this scope is to be understood as to be defined by the appended claims, in their legitimate and proper interpretation. In the drawings, like reference symbols denote like parts and dimensions and so on in the separate figures thereof; spatial terms are to be understood as referring only to the orientation on the drawing paper of the relevant figure and not to any actual orientation of an embodiment, unless otherwise qualified; in the description, all percentages are to be understood as being by weight unless otherwise indicated; and:

DESCRIPTION OF THE PREFERRED EMBODIMENTS

The present invention will now be described in detail with respect to several preferred embodiments thereof, and with reference to the drawings.

THE FIRST SET OF TESTS

(RELATION BETWEEN NON FIBROUS PARTICLE AMOUNT AND SIZE AND MACHINABILITY AND TOOL WEAR)

A quantity of mineral fibers was dispersed in water. This mineral fiber material was of the type manufactured by the Jim Walter Resources Company, with trade name "PMF" (Processed Mineral Fiber), and had a nominal composition of 40% to 50% $SiO_x$, 34% to 42% CaO, 4% to 15% $Al_2O_3$, 3% to 10% MgO, 0% to 3% $Fe_2O_3$, and 0% to 7% other inorganic substances; the fibers contained therein had an average fiber diameter of 5 microns and an average fiber length of 2 millimeters, and a quantity of non fibrous material was intermingled with them. After dispersing this quantity of material in the water, the dispersion was passed through a 100 mesh stainless steel net, by which means the non fibrous particles were largely eliminated. The thus separated mineral fibers and non fibrous particles were then recombined in various proportions, and, in order to evaluate the effect of varying the amount of included non fibrous particles and the amount of included non fibrous particles of diameter greater that or equal to 150 microns on machinability and tool wear, six preforms of mineral fibers designated as A1 through A6, with varying amounts of non fibrous particles commingled therewith, were made, with parameters as detailed in Table I at the end of this specification and before the claims thereof. As will be understood from this Table I, the six preforms A1 through A6 had widely differing amounts of non fibrous particles included in them, and also widely differing amounts of large non fibrous particles of diameter 150 microns or more; but the amount of binder, in volume and in weight percentage, and the volume proportion of the preforms, were substantially the same for all the preforms A1 through A6.

Figure 1:
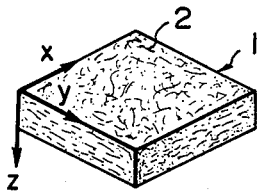
FIG. 1 is a perspective view showing a preform made of reinforcing fibers stuck together with a binder, said preform being generally cuboidal, and particularly indicating the non isotropic orientation of said reinforcing fibers.

In more detail, each of these preforms was made in the following way. First, the mineral fibers and the non fibrous particles were mixed together in the appropriate proportions (as per Table I) and were dispersed in colloidal silica, which acted as a binder: the mixture was then well stirred up so that the mineral fibers and the non fibrous particles were evenly dispersed therein, and then the preform was formed by vacuum forming from the mixture, said preform 1 having dimensions of 80 by 80 by 20 millimeters, as shown in perspective view in FIG. 1. As suggested in FIG. 1, the orientation of the mineral fibers 2 in these preforms 1 was not isotropic in three dimensions: in fact, the mineral fibers 2 were largely oriented parallel to the larger sides of the cuboidal preform, i.e. in the x-y plane as shown in FIG. 1, and were substantially randomly oriented in this plane; but the fibers 2 did not extend very substantially in the z direction as seen in FIG. 1, and were, so to speak, somewhat stacked on one another with regard to this direction. Finally the preform was fired in a furnace at about 600° C., so that the silica bonded together the individual mineral fibers 2, acting as a binder.

Figure 3:
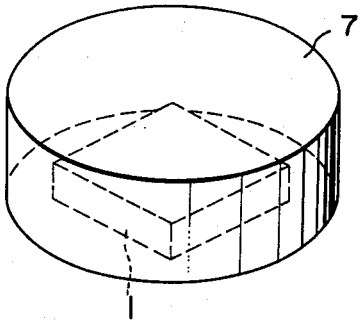
FIG. 3 is a perspective view of a solidifed cast lump of matrix metal with said preform of FIG. 1 in its interior, as removed from the FIG. 2 apparatus after having been cast therein.
Figure 2:
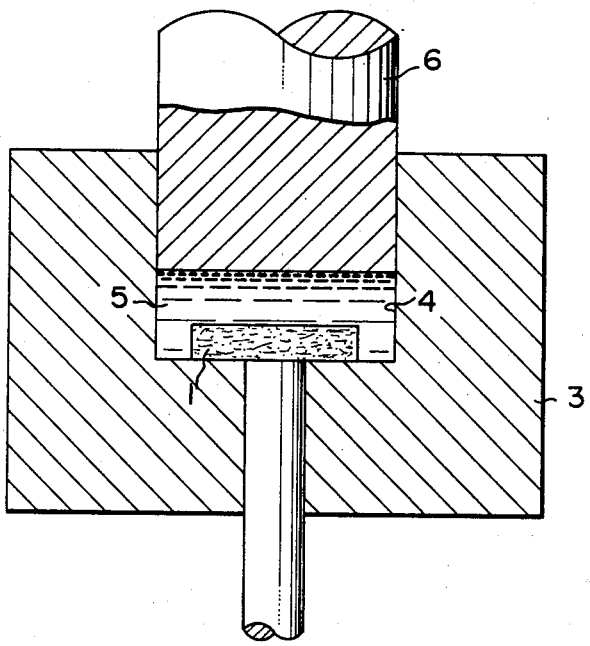
FIG. 2 is a schematic sectional diagram showing a mold with a mold cavity and a pressure piston which is being forced into said mold cavity in order to pressurize molten matrix metal around the preform of FIG. 1 which is being received in said mold cavity, during a casting stage of a process of manufacture of the composite material of the present invention.

Next, a casting process was performed one each of the preforms A1 through A6, as schematically shown in FIG. 2. Each of the preforms 1 was placed into the mold cavity 4 of a casting mold 3, and then a quantity 5 of molten metal for serving as the matrix metal for the resultant composite material, in the case of this first preferred embodiment being molten aluminum alloy of type JIS (Japan Industrial Standard) AC8A and being heated to about 740° C., was poured into the mold cavity 4 over and around the preform 1. Then a pressure piston 6, which closely cooperated with the surface of the mold cavity 4, was fitted into said mold cavity 4 and was forced inwards, so as to pressurize the molten matrix metal to a pressure of about 1500 kg/cm$^2$ and to thus force it into the interstices between the fibers 2 of the preform 1. This pressure was maintained until the mass 5 of matrix metal was completely solifidied, and then the resultant cast form 7, schematically shown in FIG. 3, was removed from the mold cavity 4. This cast form 7 was cylindrical, with diameter about 110 millimeters and height about 50 millimeters. Finally, heat treatment of type T7 was applied to this cast form 7, and from the part of it in which the fiber preform 1 was embedded was cut a test piece of composite material, of dimensions about 80 by 80 by 20 millimeters; thus, in all, six such test pieces T1 through T6 were manufactured, each respectively corresponding to one of the preforms A1 through A6 of Table I. As will be understood from the following, this set of tests pieces T1 through T6 included one or more preferred embodiments of the present invention and one or more comparison samples which were not embodiments of the present invention.

Each of these test pieces T1 through T6 was then machined for a fixed time, using a super hard tool, at a cutting speed of 150 m/min, a feed rate of 0.03 millimeters per cycle, and using water as a coolant, and the amount of wear in millimeters on the flank of the super hard tool was measured in each case. The results of these measurements are shown in FIG. 4, which is a bar chart showing amount of wear on the super hard tool on the vertical axis, for each of the test pieces T1 through T6.

Figure 4:
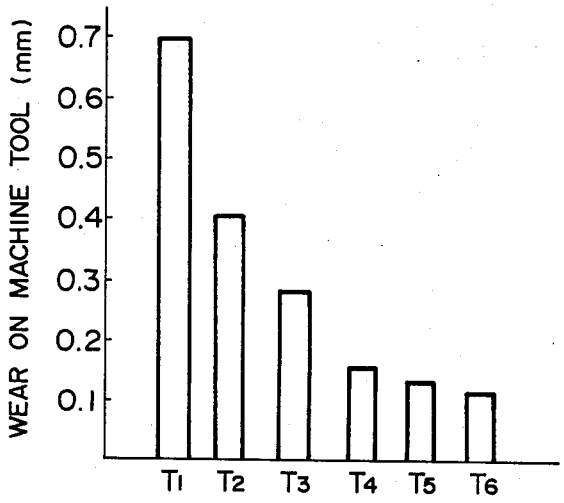
FIG. 4 is a bar chart showing on the vertical axis the amount of wear on a super hard tool after a fixed amount of machining of each of six test pieces T1 through T6.

From the results of these measurements as shown in FIG. 4, it will be apparent that the test pieces T1 and T2 of composite material, which were made using as reinforcing material the preforms A1 and A2 which contained relatively high amounts of non fibrous particles with diameters 150 microns or greater, had very poor machinability as compared with the other four test pieces T3 through T6 which contained less non fibrous particles with diameters 150 microns or greater, and caused very much more wear on the machining tool. Accordingly, it is considered that, from the point of view of machinability and of wear on a machining tool, it is desirable that the total amount of non fibrous particles intermingled with the fibrous reinforcing material for the composite material according to this invention should be less than or equal to about 20% by weight, and preferably should be less than or equal to about 10% by weight; and that the amount of non fibrous particles of diameter 150 microns or more should be less than or equal to about 7% by weight, and preferably should be less than or equal to about 2% by weight.

THE SECOND SET OF TESTS

(RELATION BETWEEN AMOUNT OF NON FIBROUS PARTICLES AND BENDING STRENGTH)

Using a mineral fiber material again of the type manufactured by the Jim Walter Resources Company with trade name "PMF" (Processed Mineral Fiber), having a nominal composition of 40% to 50% $SiO_2$, 34% to 42% CaO, 4% to 15% $Al_2O_3$, 3% to 10% MgO, 0% to 3% $Fe_2O_3$ and 0% to 7% other inorganic substances, and with fibers with an average fiber diameter of 5 microns and an average fiber length of 200 microns and with a quantity of intermingled non fibrous material, as before, after dispersing this quantity of material in water and separating out the fibrous particles therefrom by a stainless steel net, in order to evaluate the effect of varying the amount of included non fibrous particles and the amount of included non fibrous particles of diameter greater that or equal to 150 microns on bending strength, six preforms of mineral fibers designated as B1 through B6, with varying amounts of non fibrous particles commingled therewith, were made in substantially the same way as in the case of the first set of tests described above, with parameters as detailed in Table II at the end of this specification and before the claims thereof. As will be understood from this Table II, the six preforms B1 through B6 had widely differing amounts of non fibrous particles included in them, and also widely differing amounts of large non fibrous particles of diameter 150 microns or more; but the amount of binder, in volume percentage, and the volume proportion of the preforms, were substantially the same for all the preforms B1 through B6. And next a casting process similar to the previously described one was performed on each of the preforms B1 through B6, again using as matrix metal molten aluminum alloy of type JIS (Japan Industrial Standard) AC8A, with melt temperature of about 740° C., and casting pressure of about 1500kg/cm$^2$, and as before heat treatment of type T7 was applied to the resulting cast form. Thus, in all, six such test pieces U1 through U6 were manufactured, each respectively corresponding to one of the preforms B1 through B6 of Table II. Then, in each of the six cases, from the part of the cast form in which the fiber preform was embedded was cut a bending strength test piece of composite material, with length about 50 millimeters, width about 10 millimeters, and thickness about 2 millimeters, and with the 50 by 10 millimeter plane parallel to the x-y plane as indicated in FIG. 1 and with thus most of the reinforcing fibers lying parallel to it. As will be understood, this set of test pieces U1 through U6 included one or more preferred embodiments of the present invention and one or more comparison samples which were not embodiments of the present invention.

For each of these test pieces U1 through U6, a three point bending test was carried out at an operating temperature of 250° C. with the gap between the support points of 39.5 mm, and a cross head speed of 1 mm/min. For purposes of comparison, a test piece designated as U0 of the same size was made using as reinforcing material a mineral fiber preform the material for which was processed in a similar manner to the manner described above for particle removal so that the total amount of non fibrous particles and also the amount of non fibrous particles with a fiber diameter of 150 microns or more were both substantially zero, and again using as matrix metal aluminum alloy (Japan Industrial Standard AC8A), and bending tests were carried out on it under the same conditions. In these bending strength tests, the bending strength of the composite material sample was measured as the surface stress at breaking point M/Z, where M was the bending moment at the breaking point, and Z was the cross sectional coefficient of the sample.

Figure 5:
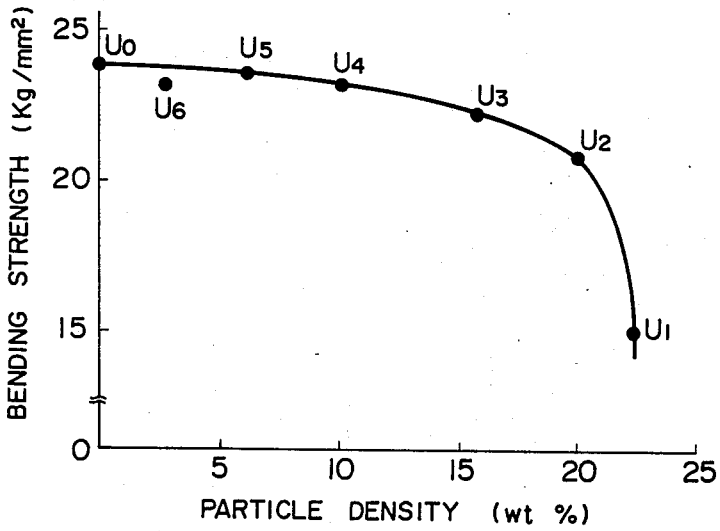
FIG. 5 is a graph showing bending strength relative to non fibrous particle content for each of seven test samples U1 through U6 and U0, with total amount of non fibrous particles as a weight percentage being shown along the horizontal axis and with the corresponding bending strength in $kg/mm^2$ being shown along the vertical axis.
Figure 6:
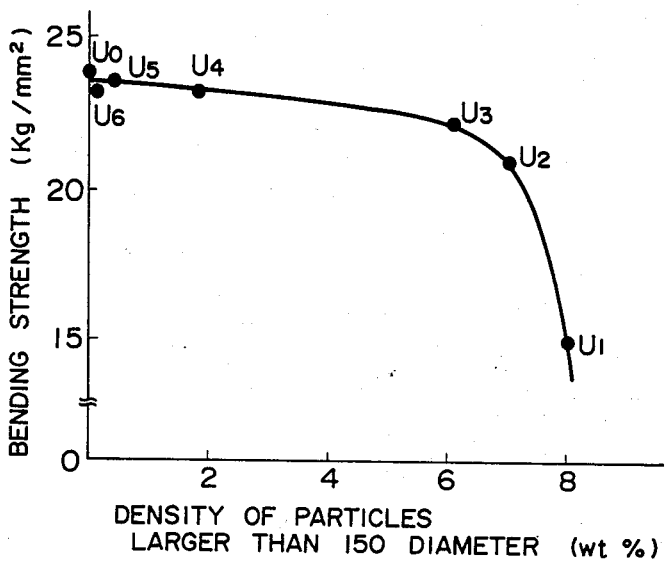
FIG. 6 is a graph showing bending strength relative to large non fibrous particle content for each of the seven test samples U1 through U6 and U0, with total amount of non fibrous particles with diameter greater than or equal to 150 microns as a weight percentage being shown along the horizontal axis and with the corresponding bending strength in $kg/mm^2$ being shown along the vertical axis.

The results of these bending strength tests are shown in FIGS. 5 and 6. In FIG. 5 there is given a graph showing bending strength for each of the seven test samples U1 through U6 and U0, with total amount of non fibrous particles (as a weight percentage) being shown along the horizontal axis, and with the corresponding bending strength in kg/mm$^2$ being shown along the vertical axis. And in FIG. 6 there is given a graph showing bending strength for each of the seven test samples U1 through U6 and U0, with total amount of non fibrous particles with diameter greater than or equal to 150 microns (as a weight percentage) being shown along the horizontal axis, and with the corresponding bending strength in kg/mm$^2$ being shown along the vertical axis.

From these graphs in FIGS. 5 and 6, it will be apparent that particularly the test samples U1 and U2, which contain relatively high amounts of non fibrous particles and which in particular contain relatively high amounts of non fibrous particles with a diameter greater than or equal to 150 microns, have a high temperature bending strength which is relatively low as compared with the other test samples U3 through U6 and U0. Accordingly, it is considered that, from the point of view of bending strength, it is desirable that the total amount of non fibrous particles intermingled with the fibrous reinforcing material for the composite material according to this invention should be less than or equal to about 20% by weight, and preferably should be less than or equal to about 10% by weight; and that the amount of non fibrous particles of diameter 150 microns or more should be less than or equal to about 7% by weight, and preferably should be less than or equal to about 2% by weight.

THE THIRD SET OF TESTS

(RELATION BETWEEN VOLUME PROPORTION OF MINERAL FIBERS AND WEAR AMOUNT AND BENDING STRENGTH)

In order to evaluate the effect of varying the quantity of mineral fibers in the composite material, using a mineral fiber material again of the type manufactured by the Jim Walter Resources Company with trade name "PMF" (Processed Mineral Fiber), having a nominal composition of 40% to 50% $SiO_2$, 34% to 42% CaO, 4% to 15% $Al_2O_3$, 3% to 10% MgO, 0% to 3% $Fe_2O_3$ and 0% to 7% other inorganic substances, seven preforms of mineral fibers designated as C1 through C1, with varying percentage amounts of mineral fibers but with substantially the same proportions of non fibrous particles and of binder, were made, as shown in Table III at the end of this specification and before the claims thereof. The fibers all had an average fiber diameter of 5 microns, and the fibers used for the preforms C1 and C2 had an average fiber length of 2 millimeters, the fibers used for the three preforms C3 through C5 had an average fiber length of 200 microns, while the fibers used for the preforms C6 and C7 had an average fiber length of 100 microns. And a certain quantity of intermingled non fibrous material was intermingled with the mineral fibers, as before. After these preforms had been made in substantially the same way as described previously in relation to the first two preferred embodiments of this invention, next a casting process similarly to the previously described one was performed on each of the preforms C1 through C7, again using as matrix metal molten aluminum alloy of type JIS (Japan Industrial Standard) AC8A, with melt temperature of about 740° C., and casting pressure of about 1500 kg/cm$^2$, and as before heat treatment of type T7 was applied to the resulting cast form. Then, in each of the seven cases, from the part of the cast form in which the fiber preform was embedded was cut a test piece of composite material with dimensions about 15.7 by 6.35 by 10.16 millimeters. Thus, in all, seven such test pieces W1 through W7 were manufactured, each respectively corresponding to one of the preforms C1 through C7 of Table III. And, for purposes of comparison, an eighth test piece W0 of the same size was made from substantially pure aluminum alloy of the same type, i.e. JIS (Japanese Industrial Standard) AC8A. As will be understood from the following, this set of test pieces W1 through W6 included one or more preferred embodiments of the present invention and one or more comparison samples which were not embodiments of the present invention.

In turn, each of these test pieces W0 through W7 was mounted in a LFW friction wear test machine, and its 15.7 by 6.35 millimeter test surface was brought into contact with the outer cylindrical surface of a mating element, which was a ring of outer diameter 35 millimeters, inner diameter 30 millimeters, and width 10 millimeters, made of spheroidal graphite cast iron. While supplying lubricating oil (Castle Motor Oil (a trademark) 5W-30) at a temperature of 25° C. to the contacting surfaces of the test pieces, in each case a friction wear test was carried out by rotating the mating element for one hour, using a contact pressure of 20 kg/mm$^2$ and a sliding speed of 0.3 meters per second.

Figure 7:
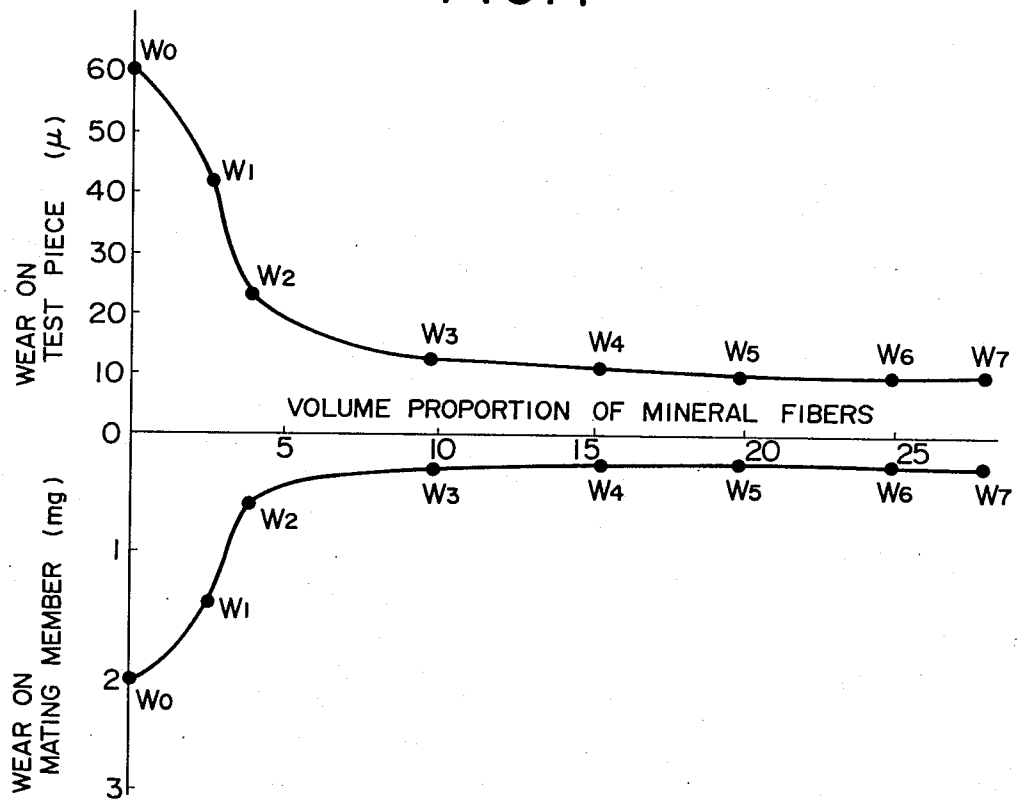
FIG. 7 is a two sided graph, showing for each of eight test pieces W0 through W7 in its upper half the amount of wear in microns during a friction wear test on the actual test piece, and in its lower half the amount of wear in milligrams on the mating member which rubbed thereagainst in said test, with the volume proportion of reinforcing mineral fibers for each test piece being shown on the horizontal axis.

The results of these friction wear tests are shown in FIG. 7. In this figure which is a two sided graph, for each of the test pieces W0 through W7, the upper half shows the amount of wear on the actual test piece of composite material (or, in the case of test piece W0, pure aluminum) in microns, and the lower half shows the amount of wear on the mating member (i.e., the cast iron ring) in milligrams. And the volume proportion in percent of mineral fiber material for each of the test pieces is shown along the horizontal axis.

Now from this FIG. 7 it will be understood that, when the volume proportion of mineral fibers is in the range from 0% to about 4%, then the wear amounts both of the test piece itself and of the mating member against which it is frictionally contacted are relatively high; but as the volume proportion of mineral fibers rises to 5% the amounts of wear on both of the members drop very sharply. However, when the volume proportion of mineral fibers in the test piece is 5% or more, then the wear amounts of the test piece and of the mating member both remain substantially constant along with further increase of the volume proportion of mineral fibers. Accordingly, it is considered that, from the point of view of wear on the test piece and on the mating member, it is desirable that the volume proportion of mineral fiber material incorporated as fibrous reinforcing material for the composite material according to this invention should be greater than or equal to about 4%, and preferably should be greater than or equal to about 5%.

Further to this result, although the detailed test results are not given herein in the interests of brevity of explanation, other embodiments of the present invention and other test samples were made in manners similar to the above but using as matrix metal not aluminum alloy but instead: in one case, copper alloy; in another case, tin alloy; in another case, lead alloy; and in yet another case, zinc alloy. When wear tests similar to the ones described above with respect to the third set of embodiments of the present invention were carried out on these various test pieces, using as a mating member a cylindrical piece of stainless steel of type JIS (Japan Industrial Standard) SUS420J2, of hardness Hv (10 kg) equal to 500, the results obtained showed substantially similar tendencies to the ones summarized above relating to the third set of test samples.

Next, from the composite material (and one pure aluminum alloy) pieces W0 to W7 as described above utilizing aluminum alloy as the matrix metal and mineral fibers as the reinforcing fibers (if any), there were made eight bending test pieces W0′ through W7′, each with dimensions 10 millimeters by 2 millimeters by 50 millimeters, with the 10 millimeter by 50 millimeter surface parallel to the x-y plane as seen in FIG. 1, i.e. with the general orientation of the reinforcing fibers lying parallel to it. Each of these test pieces W0′ through W7′ was mounted in a three point bending test machine, and a three point bending test was carried out at an operating temperature of 350° C. with the gap between the support points of 39.5 mm, and a cross head speed of 1 mm/min.

Figure 8:
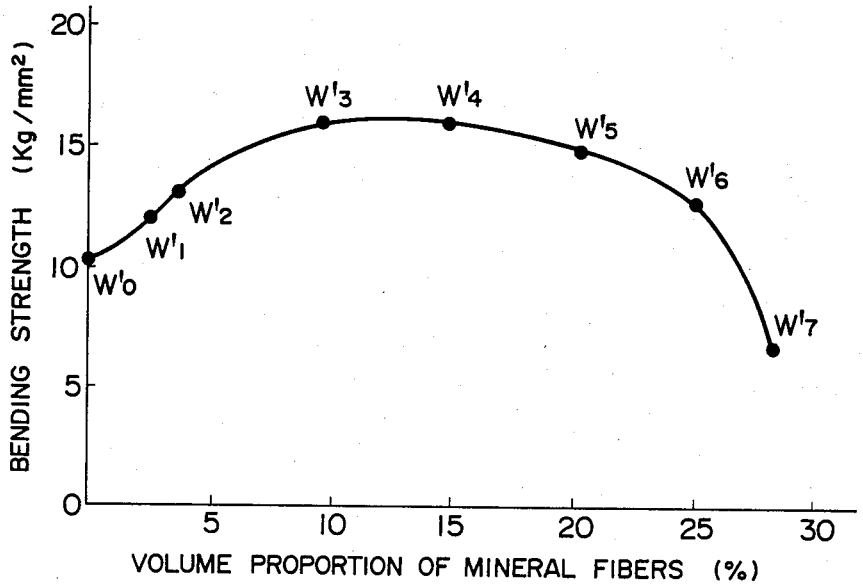
FIG. 8 is a graph showing bending strength for each of these eight test samples, with the volume proportion of mineral fibers as a volume percentage being indicated along the horizontal axis, and with the corresponding bending strength at 350° C. in $kg/mm^2$ being indicated along the vertical axis.

The results of these bending strength tests are shown in FIG. 8. In FIG. 8 there is given a graph showing bending strength for each of the seven test samples W1 through W6 and W0, with the volume porportion of mineral fibers as a volume percentage being shown along the horizontal axis, and with the corresponding bending strength in kg/mm$^2$ being shown along the vertical axis.

From this graph of FIG. 8, it will be apparent that the test samples which have a volume proportion of mineral reinforcing fibers in the relatively small range of 4% or less have a high temperature bending strength which, although somewhat low as compared with some of the other test samples, is acceptable; however, the test samples which have a volume proportion of mineral reinforcing fibers in the range greater than or equal to 20% have substantially lowered high temperature bending strength, and particularly when the volume proportion of mineral reinforcing fibers rises to about 25% or greater then the high temperature bending strength is very much deteriorated. Accordingly, it is considered that, from the point of view of high temperature bending strength, it is desirable that the volume percentage of reinforcing fibrous reinforcing material for the composite material according to the present invention should be less than or equal to about 25%, and preferably should be less than or equal to about 20%.

Thus, as an overall conclusion from the above set of tests relating to variation of the amount of reinforcing mineral fibers, it is seen that it is desirable that the volume proportion of reinforcing fibrous material in the composite material of the present invention should be restricted to be in the range of 4% to 25%, and more preferably should be restricted to be in the range of 5% to 20%.

THE FOURTH SET OF TESTS (USING BRONZE AS MATRIX METAL FOR SINTERING)

In order to evaluate the effect of preparing the composite material in a different way, a quantity of mineral fiber material of the type manufactured by Nitto Boseki KK, having a nominal composition of 38% to 42% $SiO_2$, 36% to 42% CaO, 12% to 18% $Al_2O_3$, 4% to 8% MgO, and 0% to 1% $Fe_2O_3$, with an average fiber diameter of 5 microns and an average fiber length of 30 microns, was subjected to non fibrous particle elimination processing, so as to reduce the total amount of non fibrous particles contained therein to about 9.7% by weight and the total amount of non fibrous particles with diameter greater than or equal to about 150 microns to about 1.6% by weight. Next, ethanol was added to the thus produced fiber collection, and the mixture was stirred for about five minutes with a stirrer, thus separating the mineral fibers. Next, the mixture was divided into two parts, and a quantity of bronze powder (10% by weight Sn, the remainder substantially Cu), with mean particle size of 20 microns, was added to the two parts in different amounts, to form two mixes, and these mixes were each mixed in a mixer agitator machine for about 30 minutes. Then, after each mix had been dried at 80° C. for about 5 hours, an appropriate quantity thereof was packed into the cavity of a mold, said cavity having cross sectional dimensions of 15.02 by 6.52 millimeters, and then a punch was pressed into the mold, so as to pressurize the dried mix to about 4000 $kg/cm^2$ to form a pressed block. These two blocks were then sintered in a batch type sintering furnace by being heated to about 770° C. for about 30 minutes, in an atmosphere of decomposition ammonia gas (dew point −30° C.), and then they were cooled slowly in a cooling zone of the sintering furnace, so as to form test pieces X1 and X2 of composite material. The parameters of these two test pieces of composite material X1 and X2 are shown in Table IV located at the end of this specification and before the claims thereof. The amounts of reinforcing fiber material in the two test pieces X1 and X2 were substantially different, while on the other hand the amounts of non fibrous particles included in them, and the amounts of non fibrous particles with diameters greater than or equal to 150 microns, were substantially identical.

Figure 9:
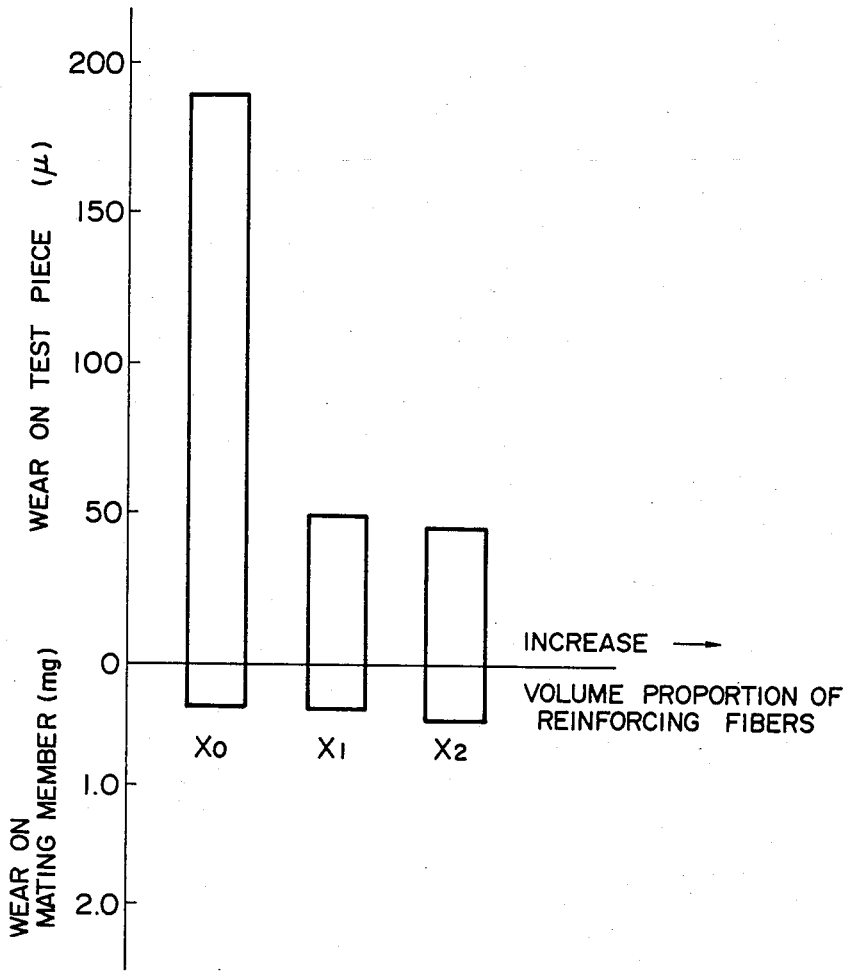
FIG. 9 is a two sided bar chart showing, for each of three test pieces X0 through X3 made using magnesium alloy as matrix metal, in its upper half the amount of wear in microns during a wear test on the actual test piece, and in its lower half the amount of wear on the mating member which cooperated therewith in said wear test in milligrams.

From these two test pieces X1 and X2, block test pieces for a friction wear test were made, and using mating cylindrical test elements of bearing steel of type JIS (Japanese Industrial Standard) SUJ2, of hardness Hv equal to 710, under the same operational conditions as in the previous tests, wear tests were carried out. Further, for purposes of comparison, another block test piece X0 was made using only bronze sintered in the same way as were the two test pieces X1 and X2 which contained the reinforcing fiber material, and the same wear test was carried out for this comparison test piece X0 also. The results of these wear tests are shown in FIG. 9. In this figure which is a two sided bar chart, for each of the test pieces X0 through X3, the upper half shows the amount of wear on the actual test piece of composite material (or, in the case of test piece X0, pure bronze) in microns, and the lower half shows the amount of wear on the mating member (i.e., the steel cylinder) in milligrams. And the volume proportion in percent of mineral fiber material for each of the test pieces increases in the direction along the horizontal axis, although it is not strictly proportionally shown. From this FIG. 9 it will be understood that also when bronze is used as the matrix metal the wear resistance of the composite material is good, as compared to that of the bronze matrix metal by itself, and also the characteristics for wear on the mating member are much improved.

USE OF MAGNESIUM AS MATRIX METAL

In order to evaluate the effect of the use of magnesium as the matrix metal, a quantity of mineral fiber material of the type manufactured by Nihon Cement KK under the trade name "Asano Mineral Fiber", having a nominal composition of 35% to 45% $SiO_2$, 30% to 40% CaO, 10% to 20% $Al_2O_3$, and 0% to 10% MgO, was subjected to non fibrous particle elimination processing, so as to reduce the total amount of non fibrous particles contained therein to about 5.4% by weight and the total amount of non fibrous particles with diameter greater than or equal to about 150 microns to about 0.2% by weight. Next, in substantially the same manner as detailed above with regard to the first set of tests, a preform having dimensions of 80 by 80 by 20 millimeters was formed from this material, and was fired in a furnace at about 600° C. Then a casting process was performed on this preform, by placing it into the mold cavity of a casting mold, by pouring a quantity of molten magnesium alloy of type ASTM standard AZ91 heated to about 700° C. for serving as the matrix metal for the resultant composite material into said mold cavity over and around the preform, by then fitting a pressure piston which closely cooperated with the surface of the mold cavity into said mold cavity, and by forcing said pressure piston inwards so as to pressurize the molten matrix metal to a pressure of about 1500 $kg/cm^2$ and to thus force it into the interstices between the fibers of the preform. This pressure was maintained until the mass of matrix metal was completely solifidied, and then the resultant cast form was removed from the mold cavity, and from the part of it in which the fiber preform was embedded was cut a test piece of composite material, consisting of magnesium matrix metal with reinforcing mineral fibers embedded in it.

This test piece of composite material was then subjected to the same test with regard to wear as was detailed with regard to the third set of tests described above, using as the mating element a cylindrical test piece of spheroidal graphite cast iron of type JIS (Japanese Industrial Standard) FCD70. As a result of this test, it was confirmed that, as compared with a piece of simple magnesium alloy of the same type with no reinforcing mineral fibers embedded therein, this composite material had far superior wear resistance characteristics, and far better characteristics with regard to wear on the mating member.

Thus, it is seen that, according to this composition for a composite material according to the present invention, the matrix metal is reinforced by mineral fibers which are very much cheaper than the type of inorganic fibers, such as alumina fibers and so on, discussed above with relation to the prior art. Accordingly, the composite material according to the present invention has the advantage that it utilizes much cheaper materials than has heretofore been practicable. Further, these type of mineral fibers have good wettability with respect to the specified type of molten matrix metal, and yet no deleterious reaction therebetween substantially occurs; these facts make for durability and strength of the composite material. Thus, this type of composite material including reinforcing mineral fibers is cheap with regard to manufacturing cost, and, by virtue of the restriction of the amount of reinforcing mineral fibers to between about 4% and about 25 % by volume, is light and has good mechanical strength and particularly good bending strength. Further, in virtue of the restriction of the total percentage amount of the non fibrous particles to not more than about 20% by weight, and the restriction of the weight percentage of the part of said non fibrous particles which have a diameter of greater than or equal to about 150 microns to between about 0% and about 7%, this composite material including reinforcing mineral fibers, as has been demonstrated by the above test results, has good machinability, and does not cause undue wear on a tool by which it is machined, and a finished part made of this composite material has good wear characteristics with regard to wear on itself during use, and further does not cause undue wear on a mating member against which it is frictionally rubbed during use. Further, this composite material has good resistance against heat and burning.

Although the present invention has been shown and described in terms of several preferred embodiments thereof, and with reference to the appended drawings, it should not be considered as being limited thereby. Many possible variations on the shown preferred embodiments are possible, without departing from the scope of the present invention; and likewise the presently appended drawings may contain various features which are not essential to the gist of the present invention. Accordingly, the scope of the present invention, and the protection desired to be accorded by Letters Patent, are not to be defined by any of the details of the terms of the above description, or by any particular features of the hereto appended drawings, but solely by the legitimate and proper scope of the accompanying claims, which follow.

TABLE I

| | fiber form | | | | | |
|---|---|---|---|---|---|---|
| | A1 | A2 | A3 | A4 | A5 | A6 |
| Total particle amount wt % | 22.5 | 19.9 | 16.5 | 10.2 | 6.1 | 2.5 |
| Amount of particles 150 microns or more wt % | 8.1 | 7.0 | 6.2 | 1.8 | 0.4 | 0.1 |
| Amount of binder vol % | 13.5 | 13.3 | 13.4 | 13.5 | 13.7 | 13.6 |
| wt % | 10.7 | 10.5 | 10.6 | 10.7 | 10.8 | 10.8 |
| Fiber body volume proportion % | 10.1 | 10.0 | 10.2 | 10.4 | 10.1 | 9.7 |

TABLE II

| | fiber form | | | | | |
|---|---|---|---|---|---|---|
| | B1 | B2 | B3 | B4 | B5 | B6 |
| Total particle amount wt % | 22.3 | 19.8 | 16.4 | 10.1 | 6.2 | 2.7 |
| Amount of particles 150 microns or more wt % | 8.6 | 7.0 | 6.1 | 1.8 | 0.4 | 0.1 |
| Amount of binder vol % | | | 13.5 | | | |
| Fiber body volume proportion % | | | 19.9 | | | |

TABLE III

| Fiber form | Volume proportion % | Particle amount wt % | Binder amount vol % (wt %) |
|---|---|---|---|
| C1 | 2.8 | 6.1 (0.4) | 13.4 (10.6) |
| C2 | 3.9 | 6.1 (0.4) | 13.7 (10.8) |
| C3 | 10.1 | 6.1 (0.4) | 13.7 (10.8) |
| C4 | 15.2 | 6.1 (0.4) | 13.4 (10.6) |
| C5 | 15.2 | 6.1 (0.4) | 13.5 (10.7) |
| C6 | 24.9 | 6.1 (0.4) | 13.3 (10.5) |

TABLE III-continued

| Fiber form | Volume proportion % | Particle amount wt % | Binder amount vol % (wt %) |
|---|---|---|---|
| C7 | 28.1 | 6.1 (0.4) | 13.5 (10.7) |

TABLE IV

| | Composite material | |
|---|---|---|
| | X1 | X2 |
| Total amount of particles wt % | 9.7 | 9.7 |
| Amount of particles 150 microns or more wt % | 1.6 | 1.6 |
| Fiber volume proportion % | 4.3 | 19.3 |
| Matrix Metal | Bronze (Cu—10 wt % Sn) | |

What is claimed is:

1. A composite material, comprising:

(a) a reinforcing fiber material with the principal components being $SiO_2$ or CaO or $Al_2O_3$ or any combination thereof, and having a MgO content by weight of between about 0% and about 10%, a $Fe_2O_3$ content by weight of between about 0% and about 5%, and a content by weight of other inorganic substances of between about 0% and about 10%, said reinforcing fiber material consisting essentially of:

(i) mineral fibers, wherein the average fiber diameter of said mineral fibers is between about 2 and about 8 microns, and wherein the average fiber length of said mineral fibers is between about 20 microns and about 5 cm; and (ii) non-fibrous particles having a total percentage of not more than about 20% by weight of the reinforcing fiber material, the weight percentage of the part of said non-fibrous particles which have a diameter of greater than or equal to about 150 microns being not greater than about 7%; and (b) a matrix metal selected from the group consisting of aluminum, magnesium, copper, zinc, lead, tin and alloys having these as principal components; and wherein the volume proportion of said mineral fibers is in the range of from about 4% to about 25%.

2. The composite material according to claim 1, wherein the volume proportion of said mineral fibers is in the range of from about 5% to about 2%.

3. The composite material according to claim 1, wherein the total percentage of said non fibrous particles is not greater than about 10% by weight, and the weight percentage of the part of said non fibrous particles which have a diameter of greater than or equal to about 150 microns is not greater than about 2%.

4. The composite material according to claim 1, wherein said mineral fibers are artificial fiber materials selected from the group consisting of rock wool or rock fiber which is made by forming molten rock into fibers, slag wool or slag fiber which is made by forming iron slag into fibers, and mineral wool or mineral fiber which is made by forming a molten mixture of rock and slag into fibers.

5. The composite material according to claim 1, which consists essentially by weight of 40% to 50% $SiO_2$, 34% to 42% CaO, 4% to 15% $Al_2O_3$, 3% to 10% MgO, 0% to 3% $Fe_2O_3$ and 0% to 7% of other inorganic substances and with fibers having an average fiber diameter of 5 microns with an average fiber length of 200 microns.

6. The composite material according to claim 1, wherein the average fiber length of said mineral fibers is between about 20 microns and about 2 millimeters.

7. The composite material according to claim 6, wherein the compounding of said mineral fibers and said matrix metal is effected by compressing and sintering the same.

* * * * *